United States Patent [19]

Galvin et al.

[11] 4,024,519

[45] May 17, 1977

[54] INTRUSION ALARM TEST SYSTEM

[75] Inventors: Aaron A. Galvin, Lexington; James B. Edson, Concord, both of Mass.

[73] Assignee: American District Telegraph Company, New York, N.Y.

[22] Filed: Oct. 6, 1975

[21] Appl. No.: 620,041

[52] U.S. Cl. ..... 340/214; 340/258 A

[51] Int. Cl.[2] ..... G08B 29/00

[58] Field of Search ..... 340/214, 408, 409, 410, 340/258 A

[56] References Cited

UNITED STATES PATENTS

| | | | |
|---|---|---|---|
| 2,769,972 | 11/1956 | MacDonald | 340/410 |
| 2,779,936 | 1/1957 | Loudon et al. | 340/410 |
| 2,943,304 | 6/1960 | Schmidt | 340/410 |
| 3,452,345 | 6/1969 | Kinsey | 340/214 |
| 3,562,730 | 2/1971 | Hill et al. | 340/214 |
| 3,838,408 | 9/1974 | McMaster | 340/214 |

*Primary Examiner*—John W. Caldwell
*Assistant Examiner*—Donnie L. Crosland
*Attorney, Agent, or Firm*—Weingarten, Maxham & Schurgin

[57] ABSTRACT

For use in a multiple zone intrusion alarm system having a central control unit and a plurality of remote transceivers or other sensors, apparatus for testing the operability of the transceivers wherein the control unit includes means for deactivating all of the transceivers, and each transceiver includes means by which that transceiver can be reactivated by connection of a test circuit thereto. The test circuit is operative to measure background noise levels and alarm levels for the associated area being tested.

11 Claims, 3 Drawing Figures

INTRUSION ALARM TEST SYSTEM

FIELD OF THE INVENTION

This invention relates to intrusion alarm systems and more particularly to a test system especially useful with a multiple zone alarm system and operative with minimum disruption of normal alarm system performance.

BACKGROUND OF THE INVENTION

In a multiple zone intrusion alarm system for protection of a plurality of zones within a building or other installation, a central control unit is coupled via an interconnecting cable to a plurality of transceivers or other sensors each disposed at a respective area being protected. Each transceiver typically includes a transmitting transducer for establishing an energy pattern in the associated protected zone, a receiving transducer for receiving energy returned from the protected zone and from objects therein and a receiving preamplifier for augmenting the received signal amplitude for conveyance on the interconnecting cable back to the central control unit. Signal processing circuitry is included within the central control unit and is operative in response to signals from the transceivers to discriminate valid intruder signals from noise and spurious signal conditions and to provide an output indication of intruder presence.

In order to test the performance of the alarm system in a particular zone, the entire installation must be secured to assure that all of the zones of the system are known to be free of possible intruders in order for a valid test to be conducted in each of the zones. It has been customary in performing a test of a multiple zone alarm system to clear the entire installation so that respective zones can be tested. Alternatively, the transceivers in the zones other than the one to be tested can be capped to prevent transmission or reception of energy within the associated zones, and thereby render these zones inactive. However, individuals who may be present during the transceiver capping procedure are thereby instructed how to defeat the alarm system or how to disable the transceiver. In addition, failure to remove a cap after a test will result in the associated zone remaining inoperative with possible serious consequences by reason of failure of the system to detect an intruder in the inoperative zone. Clearing of the entire installation for conduct of a test suffers the disadvantages of time and personel required to maintain the installation in a secured condition during conduct of the test.

SUMMARY OF THE INVENTION

Briefly, the present invention provides a system for testing one or more transceivers or other sensors of a multiple zone intrusion alarm system by which all of the transceivers or sensors are deactivated at the central control unit, each of the transceivers or sensors being capable of reactivation by connection of a test circuit to that transceiver or sensor. Means are provided at the central control unit by which all of the remote transceivers or sensors can be deactivated. Each transceiver includes means by which only the particular transceiver can be reactivated by connection of a test circuit thereto and which test circuit is operative to measure the background noise and alarm levels for the area being tested.

The novel test system is useful during initial installation of an alarm system to test each of the protected zones to verify system operability, as well as being useful for requalification of a particular multiple zone installation. In typical implementation, an operate/test switch is provided at the central control unit with associated circuitry, and in a test position causes deactivation of the preamplifiers associated with the remote transceivers, thereby to render all of the zones inactive. A test circuitry typically embodied within a portable test box is connected to the transceiver of a zone to be tested to cause reactivation of that transceiver and includes one or more indicators for denoting the background noise level and alarm level sensed during the testing procedure of the particular zone. Removal of the test circuit again deactivates the associated transceiver. Each other transceiver of the system can likewise be activated by connection of the test circuit for testing of the associated zone in similar manner. In the event that more than one transceiver is provided in a particular protected zone, the test system of the invention can be implemented such that connection of the test circuit to one of the transceivers of a given zone causes reactivation of the group of transceivers in that zone. After a test procedure has been completed, the alarm system is easily reactivated for normal use simply by switching the control switch at the central control unit to its operate position. Although each of the transceivers can be locally activated for providing zone testing, the transceivers cannot be locally deactivated by connection of the test or other circuit, since according to the invention deactivation of the transceivers can be accomplished only at the central control unit.

DESCRIPTION OF THE DRAWINGS

The invention will be more fully understood from the following detailed description taken in conjunction with the accompanying drawings in which.

DETAILED DESCRIPTION OF THE INVENTION

Figure 1:
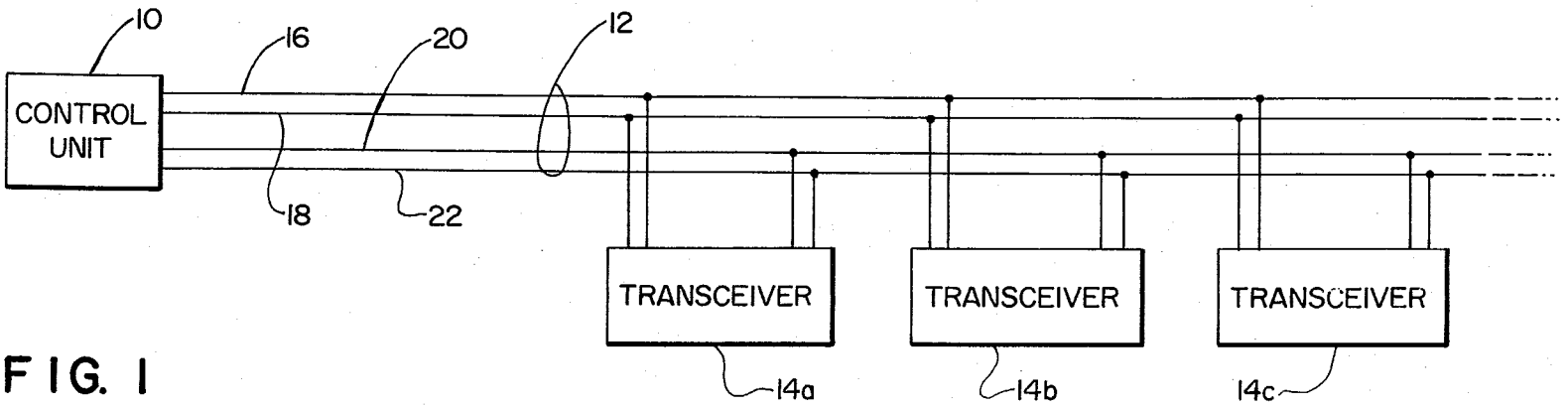
FIG. 1 is a block diagram representation of a multiple zone intrusion alarm system of the type in which the invention is employed.

An intrusion alarm system is shown in FIG. 1 of the type in which the invention is useful. Control unit 10 is connected via a multiconductor cable 12 to a plurality of of transceivers 14*a*, 14*b* and 14*c* each of which includes a transmitting tranducer connected to the transmitter lines 16 and 18 of cable 12 and a receiving transducer and associated preamplifier connected to the receiving line 20 and ground line 22 of cable 12. Each transceiver is disposed in an area to be protected and provides an electromagnetic, ultrasonic or other energy pattern in the protected area and also senses energy returned from the area and from objects therein. The control unit includes signal processing circuitry operative in response to signals returned by the respective transceivers and providing an output alarm indication upon detection of intruder presence. This signal processing circuitry usually includes circuitry for discrimination between valid intruder signals and noise or spurious signal conditions to minimize false alarms. The alarm system itself can be of many different configurations, a typical system being shown in U.S. Pat. No. 3,665,443, assigned to the assignee of this invention.

In accordance with the present invention, all transceivers of a system are disabled with the exception of that transceiver which is to be tested. The transceivers are deactivated by an appropriate control at the central control unit and the particular transceiver to be tested is reactivated by means of a test circuit at the particular transceiver.

Figure 2:
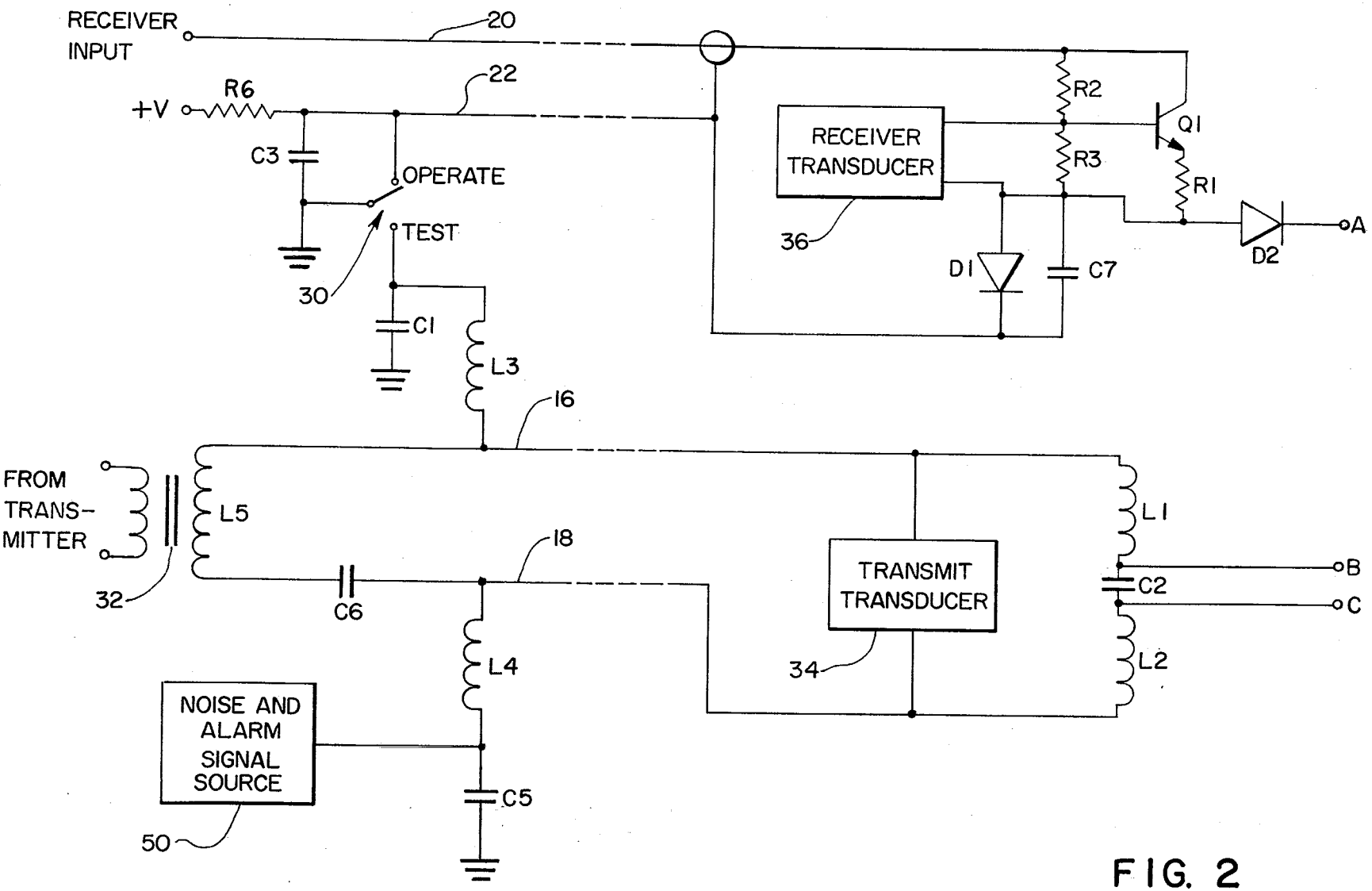
FIG. 2 is a schematic representation of the invention as embodied in an intrusion alarm system.

Referring to FIG. 2, there is shown a portion of control unit 10 connected to cable 12. More particularly, line 20 is connected to the receiver input and line 22 is connected via resistor R6 to a source of energizing potential +V. Line 22 is the shield and line 20 the center conductor of the shielded receiver line. A control switch 30 has one contact connected to line 22 and another contact coupled via capacitor C1 to ground and via inductor L3 to transmitter line 16. The common contact of switch 30 is connected to ground. Line 22 is AC grounded by means of capacitor C3. Transmitter lines 16 and 18 are connected to the secondary winding L5 of output transformer 32 of the transmitter of control unit 10. Line 18 is coupled to winding L5 via a capacitor C6 and is also coupled via inductor L4 to a noise and alarm signal source 50. A capacitor C5 is coupled to ground as shown.

In each of the transceivers 14, the transmitting transducer 34 has connected thereacross the series combination of an inductor L1, capacitor C2 and inductor L2. Test points B and C are provided, respectively, at the junctions between inductor L1 and capacitor C2 and inductor L2 and capacitor C2. The receiving transducer 36 has one terminal coupled to a preamplifier which includes a transistor Q1 and associated resistors R1, R2 and R3 connected as shown. A capacitor C7 and D1 are connected between the preamplifier bias resistors R1 and R3, and receiver shield line 22. A diode D2 connects the preamplifier output to a test point A.

Positive voltage to provide DC power to the preamplifiers is supplied via receiver signal line 20. A DC return path for the preamplifier of each transceiver 14 is diode coupled via diode D2 such that operation of any preamplifier can be restored by providing at the transceiver under test a separate DC return path for only that preamplifier. In FIG. 2 the preamplifier is normally returned to ground via diode D1 through the receiver shield line 22 back to the control unit ground. Line 22 normally carries the return DC current of all of the preamplifiers in a system. In the test mode as determined by positioning of switch 30 to the test position, the receiver shield line 22 is returned to a voltage more positive than the DC voltage applied to the receive signal lead to remove power from the receiver preamplifier by providing reverse bias. An individual preamplifier is reactivated by providing an alternate return path to ground through test point A and is conveniently accomplished without additional cable wiring by establishing a DC ground reference on one of the transmitter leads. To accomplish this, transmitter lead 16 is choke coupled via inductor L3 to the control unit ground when the control unit is in the test mode. A decoupling network including capacitor C2 and equal value inductors L1 and L2 provides separate DC access to transmitter lines 16 and 18. The transmitter signal is balanced; as a result, at test points B and C there is negligible AC voltage with respect to circuit ground. Since test point B is returned to control unit ground, any individual preamplifier may be reactivated by interconnection of test points A and B thereby to reapply power to the preamplifier. The receiver signal ground is AC referenced to the receiver shield line 22 via capacitor C7, and the shield is coupled via capacitor C3 to the control unit ground to provide a signal ground path.

Figure 3:
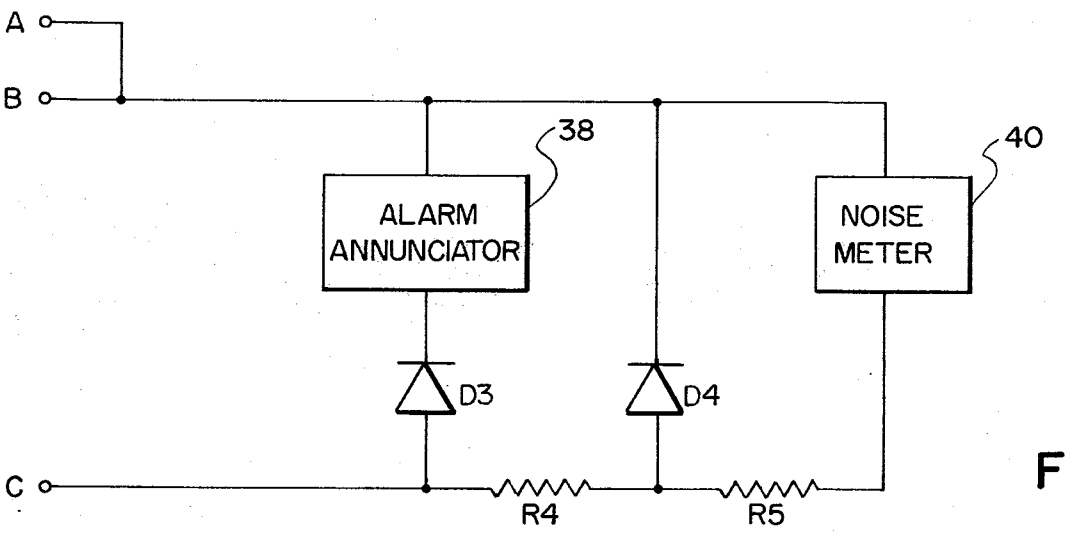
FIG. 3 is a schematic representation of a test circuit which is part of the invention.

The test circuit is shown in FIG. 3 and includes test points A, B and C typically in the form of a test plug adapted for connection to a jack associated with the corresponding test points of each transceiver 14. Test points A and B in the circuit of FIG. 2 are jumper wired to provide activation of the transceiver under test when the test circuit is plugged into the test points of the particular transcevier. Test point C is connected via a diode D3 to an alarm annunciator 38 which is also connected to test points A and B. A noise meter 40 is coupled by resistors R4 and R5 to test point C, and a diode D4 is connected between one terminal of noise meter 40 and the junction of resistors R4 and R5. Diode D3 minimizes loading of the low level noise signal by the annunciator 38 and resistors R4 and R5 adjust meter sensitivity. Diode D4 limits the signal which may be applied to meter 40 to a safe value.

A low level DC signal representative of the system noise level and a high level DC signal representative of alarm signal level are provided from a suitable source 50 at the control unit and applied via choke L4 to transmitter lines 16 and 18. At the transceiver under test, the noise and alarm signal levels can be observed, and the area can be walk tested to observe the transceiver range characteristics. Low level noise signals are provided at test point C, and with the test circuit connected to the transceiver under test, these low level noise signals are applied via resistors R4 and R5 to the meter 40. The high level alarm signal is coupled to test point C and by way of diode D3 to the alarm annunciator 38, which can be a visual indicator such as a light emitting diode or other visual or aural indicating device. A separate alarm annunciator need not be employed, as the meter 40 can also indicate the presence of an alarm signal by an over scale deflection on the meter.

It should now be evident that the invention provides a system having efficient construction and convenience of operation by which the transceives of a multiple zone intrusion alarm system can be deactivated at the central control unit and particular ones of transceivers locally reactivated at each of the transceiver sites for purposes for testing. The invention finds application in a variety of multiple zone intrusion alarm systems, which may be either active or passive and be operative with electromagnetic, ultrasonic, audio, vibration or other suitable energy. The invention is not therefore to be limited to the particular embodiment described or to the particular type of alarm system illustrated above. The invention is equally applicable in a variety of alarm systems wherein a plurality of remote sensors are connected to a central control unit. Accordingly, it is not intended to limit the invention by what has been particularly shown and described, except as indicated in the appended claims.

What is claimed is:

1. For use in an intrusion alarm system having a central control unit and a plurality of remote transceivers each including a transmitting transducer, a receiving transducer and a receiving preamplifier, apparatus for testing the operability of said transceivers comprising:

means at said control unit for deactivating all of said preamplifiers of said transceivers;

means located at and associated with each of said transceivers for allowing reactivation of the preamplifier of only the associated transceiver; and means selectively connectable to any one of said transceivers for reactivating upon connection to a transceiver the corresponding preamplifier thereof and for monitoring the noise and alarm levels of said reactivated transceiver.

2. The invention according to claim 1 wherein said deactivating means at said control unit includes:

a manually operable control switch having an operate and a test position; and means for providing a bias signal.

3. The invention according to claim 2 wherein said means at each of said transceivers includes:

means operative with said control switch in a test position to apply said bias signal to said preamplifiers for deactivation thereof;

and wherein said means adapted for connection to any one of said transceivers includes:

means for effectively removing said bias signal to reactivate the corresponding preamplifer.

4. The invention according to claim 1 wherein said deactivating means at said control unit includes:

a manually operable control switch having an operate and a test position;

means operative with said control switch in its test position to provide a reverse bias potential to said preamplifiers for deactivation of said transceivers;

and wherein said means adapted for connection to any one of said transceivers includes:

means for effectively removing said reverse bias potential to reactivate the corresponding transceiver.

5. The invention according to claim 4 wherein said means for effectively removing said bias potential includes means for establishing a DC ground reference at the corresponding transceiver.

6. For use in an intrusion alarm system having a central control unit and plurality of remote transceivers interconnected by a multi-wire cable to said central control unit, apparatus for testing the operability of said transceivers comprising:

means at said control unit for deactivating via said interconnecting cable all of said transceivers;

means located and associated with each of said transceivers for allowing reactivation of only the associated transceiver; and means selectively connectable to any one of said transceivers for reactivating at least the transceiver to which it is connected and for monitoring the noise and alarm levels of said reactivated transceiver.

7. The invention according to claim 6 wherein said means adapted for connection to any one of said transceivers includes:

a test circuit plug connectable to any one of said transceivers.

8. The invention according to claim 6 wherein said deactivating means at said control unit includes:

a manually operable control switch having an operate and a test position.

9. The invention according to claim 8 wherein said means at each of said transceivers includes:

diode means coupling said transceiver to a first test point:

a second test point coupled with said control switch in its test position via one of the transmitter lines of said interconnecting cable to ground;

a third test point coupled with said control switch in its test position via one of the transmitter lines of said interconnecting cable to a source of noise and alarm signals at said control unit;

and wherein said means adapted for connection to any one of said transceivers includes:

a test circuit having a test plug adapted for connection to said test points;

jumper means interconnecting said first and second test points to reapply power to the corresponding transceiver; and indicator means connected to said second and third test points for denoting said noise and alarm signal levels.

10. The invention according to claim 16 wherein a group of said plurality of remote transceivers is disposed in a single zone;

and wherein said means adapted for connection to any one of said transceivers includes means operative upon connection to one of said group of transceivers to reactivate the transceivers of said group.

11. The invention according to claim 6 wherein said means at said control unit includes:

a manually operable control switch having an operate and test position;

means operative with said control switch in the operate position to provide a ground return path for said transceivers via said cable, and operative with said cable, and operative with said control switch in the test position to provide a reverse bias potential on said cable to said transceivers;

means for providing a ground reference via said cable at said transceivers;

and wherein said means adapted for connection to any one of said transceivers includes;

means for returning the connected one of said transceivers to ground.

* * * * *

UNITED STATES PATENT AND TRADEMARK OFFICE

CERTIFICATE OF CORRECTION

PATENT NO. : 4,024,519

DATED : May 17, 1977

INVENTOR(S) : Aaron A. Galvin and James B. Edson

It is certified that error appears in the above-identified patent and that said Letters Patent are hereby corrected as shown below:

Column 1, line 50, "personel" should read --personnel--.

Column 2, line 52, "of of" should read --of--.

Column 2, line 58, "other energy" should read --other suitable energy--.

Column 4, line 46, "transceives" should read --transceivers--.

Column 4, line 48, "of transceivers" should read --of the transceivers--.

Column 5, line 41, "and plurality" should read --and a plurality--.

Column 5, line 47, "located and" should read --located at and--.

Column 6, line 31, "claim 16" should read --claim 6--.

Column 6, line 45, delete "said cable, and operative with".

UNITED STATES PATENT OFFICE

CERTIFICATE OF CORRECTION

Patent No. 4,024,519 Dated May 17, 1977

Inventor(s) Aaron A. Galvin et al.

It is certified that error appears in the above-identified patent and that said Letters Patent are hereby corrected as shown below:

Column 6, line 45, delete "said cable, and operative with".

Signed and Sealed this

First Day of November 1977

[SEAL]

*Attest:*

RUTH C. MASON
*Attesting Officer*

LUTRELLE F. PARKER
*Acting Commissioner of Patents and Trademarks*